US010968683B2

(12) United States Patent
Wang et al.

(10) Patent No.: US 10,968,683 B2
(45) Date of Patent: Apr. 6, 2021

(54) DOORS COMPRISING GLAZED UNIT, AND METHOD OF MAKING THE SAME

(71) Applicant: Plastpro 2000, Inc., Los Angeles, CA (US)

(72) Inventors: Shirley Wang, Los Angeles, CA (US); Jared Andrew Garrett, Mentor, OH (US); Scott Evert Johnson, Kingsville, OH (US); Sungste Lin, Rancho Palos Verdes, CA (US)

(73) Assignee: Plastpro 2000, Inc., Los Angeles, CA (US)

( * ) Notice: Subject to any disclaimer, the term of this patent is extended or adjusted under 35 U.S.C. 154(b) by 0 days.

(21) Appl. No.: 16/104,455

(22) Filed: Aug. 17, 2018

(65) Prior Publication Data

US 2019/0055774 A1 Feb. 21, 2019

Related U.S. Application Data

(60) Provisional application No. 62/547,325, filed on Aug. 18, 2017.

(51) Int. Cl.
*E06B 3/58* (2006.01)
*E06B 3/70* (2006.01)
(Continued)

(52) U.S. Cl.
CPC ..... *E06B 3/5892* (2013.01); *E06B 3/549* (2013.01); *E06B 3/5814* (2013.01);
(Continued)

(58) Field of Classification Search
CPC ..... E06B 3/549; E06B 3/56; E06B 3/5814; E06B 3/5892; E06B 3/7015; E06B 2003/7023
See application file for complete search history.

(56) References Cited

U.S. PATENT DOCUMENTS 1,104,868 A 7/1914 Bolin
1,721,770 A 7/1929 Cotton
(Continued)

FOREIGN PATENT DOCUMENTS

JP 08-177328 A 7/1996
JP 2000-017960 A 1/2000
(Continued)

OTHER PUBLICATIONS

Machine Translation of JP 2009007772 (Year: 2019).*
(Continued)

*Primary Examiner* — James M Ference
(74) *Attorney, Agent, or Firm* — Duane Morris LLP

(57) ABSTRACT

A door include a first skin, a second skin, and a glazing unit. The first skin includes a first skin body portion, and a first flange portion extending inward from the first skin body portion. The first skin body portion has a first tip. A second skin includes a second skin body portion, and a second flange portion extending inward from the second skin body portion. The second skin body portion has a second tip. A glazing unit has an edge disposed adjacent to and between the first tip and the second tip. The first flange portion and the second flange portion provide an interlocking structure.

25 Claims, 20 Drawing Sheets

(51) Int. Cl.
*E06B 3/54* (2006.01)
*E06B 3/56* (2006.01)

(52) U.S. Cl.
CPC ..... *E06B 3/7015* (2013.01); *E06B 3/56* (2013.01); *E06B 2003/7023* (2013.01)

(56) References Cited

U.S. PATENT DOCUMENTS 3,945,975 A * 3/1976 Strack ..... C08L 21/00 524/526
4,154,033 A 5/1979 Krueger et al.
4,327,535 A 5/1982 Governale
4,520,602 A 6/1985 Miller
4,720,951 A 1/1988 Thorn et al.
4,750,302 A 6/1988 Bechtold
4,826,547 A 5/1989 Lenhardt
4,850,168 A 7/1989 Thorn
4,873,803 A 10/1989 Rundo
4,897,975 A 2/1990 Artwick et al.
5,077,948 A * 1/1992 Olson ..... B29C 66/1142 52/309.9
5,123,211 A 6/1992 Schlicht
5,161,346 A * 11/1992 Olson ..... B29C 33/16 156/272.4
5,557,899 A * 9/1996 Dube ..... E06B 3/221 49/DIG. 2
5,568,713 A 10/1996 Gagne et al.
5,709,055 A 1/1998 Levi
5,802,785 A 9/1998 Crook
5,887,398 A * 3/1999 Chen ..... E06B 3/5892 49/501
6,029,411 A 2/2000 Richardson
6,082,062 A 7/2000 Alflen
6,260,255 B1 7/2001 Richardson et al.
6,312,540 B1 11/2001 Moyes
6,318,027 B1 11/2001 Richardson et al.
6,434,898 B1 8/2002 Ward et al.
6,530,183 B1 3/2003 Kuei-Yung
6,553,735 B1 4/2003 Wang Chen
6,574,935 B2 6/2003 Wang Chen
6,619,005 B1 9/2003 Chen
6,637,093 B2 10/2003 Richardson et al.
6,688,064 B1 2/2004 Swanick
6,729,095 B2 5/2004 Wang Chen
6,922,946 B2 8/2005 Gerard
7,210,274 B2 5/2007 Ballantyne et al.
7,430,836 B2 10/2008 Sibbett
7,448,174 B2 11/2008 Krochmal et al.
7,543,416 B2 6/2009 Albertelli
7,621,082 B2 11/2009 Morton
7,631,464 B2 12/2009 Valentz et al.
7,721,501 B2 5/2010 Lynch et al.
7,836,643 B2 11/2010 Walch
7,856,779 B2 12/2010 Moyes
7,997,040 B2 8/2011 Lynch et al.
8,202,380 B2 6/2012 Moyes
8,256,177 B2 9/2012 Pfau et al.
8,365,480 B1 2/2013 Plummer et al.
8,394,219 B2 3/2013 Moyes
8,434,284 B1 5/2013 Plummer et al.
8,590,265 B2 11/2013 Albertelli et al.
8,650,822 B2 2/2014 Moyes
8,701,363 B2 4/2014 Schield
8,765,046 B2 7/2014 Pfau et al.
8,771,581 B2 7/2014 Pfau et al.
8,789,330 B2 7/2014 Lynch et al.
8,833,022 B2 9/2014 Moyes
8,864,926 B2 10/2014 Pfau et al.
8,869,493 B2 10/2014 Chubb et al.
9,074,413 B1 7/2015 Sprague
9,102,808 B2 8/2015 Pfau et al.
9,109,393 B2 8/2015 Moyes
9,163,449 B2 10/2015 Weiss et al.
9,290,989 B2 3/2016 Lynch et al.
9,458,660 B2 10/2016 Gouge et al.
9,464,475 B2 10/2016 Moyes
9,593,526 B2 3/2017 Wang Chen
9,624,714 B2 4/2017 Gouge et al.
9,657,511 B2 5/2017 Pfau et al.
2002/0092254 A1* 7/2002 Wang Chen ..... E06B 3/5892 52/455
2002/0108337 A1* 8/2002 Clarke ..... E05D 5/023 52/309.9
2004/0144046 A1* 7/2004 Wang ..... E06B 3/5892 52/204.1
2004/0226233 A1* 11/2004 Lasee ..... E06B 3/5892 52/204.5
2005/0028465 A1 2/2005 Horsfall et al.
2007/0204546 A1* 9/2007 Lynch ..... E06B 3/5892 52/456
2008/0209826 A1* 9/2008 Hodges ..... E06B 3/5892 52/204.7
2010/0059162 A1* 3/2010 Flanigan ..... B44D 3/225 156/60
2010/0229500 A1* 9/2010 Lynch ..... E06B 3/5892 52/784.13
2010/0263589 A1* 10/2010 Dempster ..... B05B 12/20 118/505
2010/0281805 A1* 11/2010 Garrett ..... E06B 3/822 52/309.4
2011/0131921 A1 6/2011 Chen
2013/0059083 A1* 3/2013 DeSantis ..... C09J 7/20 427/300
2014/0242377 A1* 8/2014 Kopke ..... C08K 7/02 428/323
2016/0060947 A1* 3/2016 Wang ..... E06B 3/5892 52/455
2018/0179807 A1* 6/2018 Wang ..... E06B 3/7001
2019/0055774 A1* 2/2019 Wang ..... E06B 3/5892

FOREIGN PATENT DOCUMENTS

JP 2008-208780 A 9/2008
JP 2009-007772 A 1/2009

OTHER PUBLICATIONS

Machine Translation of JP 08-177328 A (Year: 2020).*
International Search Report/Written Opinion dated Dec. 10, 2018, in corresponding International Application No. PCT/US2018/046908.
European Patent Office, Supplemental European Search Report for corresponding European Patent Appln. No. 18847116.3, dated Jan. 13, 2021.

* cited by examiner

150

DOORS COMPRISING GLAZED UNIT, AND METHOD OF MAKING THE SAME

PRIORITY CLAIM AND CROSS-REFERENCE

This application claims the benefit of U.S. Provisional Application No. 62/547,325, filed Aug. 18, 2017, which application is expressly incorporated by reference herein in its entirety.

FIELD

The disclosure relates to a door generally. More particularly, the disclosed subject matter relates to a door comprising a glazed unit, and the method of making the same.

BACKGROUND

A glazed door is a door comprising one or more glass panes or panels. The glass panes in a glazed door may be translucent or transparent, and provide desired decoration and optical clarity for the resulting door installed in residential and commercial buildings.

Fiberglass doors comprising synthetic polymers are used as substitutes for traditional wooden doors. Fiberglass doors include door skins (facings) secured to opposite sides of a rectangular door frame. A resulting cavity between the door skins and surrounded by the door frame optionally is filled with a core material. Doors so constructed can have wood graining printed, molded, or otherwise applied on the exterior surfaces of the door skins, and also raised paneling formed (e.g., molded) in the door skins. These features give the doors the appearance of natural wood fabricated products. Optionally, paint, stain, lacquer, and/or a protective layer may be applied to the exterior surface.

SUMMARY

The present disclosure provides a door comprising a glazing unit and a method of making the same. The present disclosure also provides a kit for making such a door. More particularly, the present disclosure provides a door comprising two skins, which form an interior interlocking structure. The glazing unit is assembled with the skins without using any external window frame for assembling the skins and the glazing unit in some embodiments.

In some embodiments, the door comprises a first skin, a second skin, and a glazing unit. The first skin includes a first skin body portion providing a first outer (e.g., exterior) door surface, and a first flange portion connected with and extending inwardly from the first skin body portion. The first skin body portion has a first tip (or end). The second skin includes a second skin body portion providing a second outer (e.g., exterior) door surface, and a second flange portion connected with and extending inward from the second skin body portion. The second skin body portion has a second tip.

Each flange portion may be unitarily molded with a respective skin or bonded onto the skin. In some embodiments, the first skin, including the first skin body portion and the first flange portion, is a unitary molded structure, and the second skin, including the second skin body portion and the second flange portion, is a unitary molded structure. In some embodiments, each respective flange portion and the respective skin body portion may be molded separately, and then bonded together. The first flange portion is bonded with the first skin body portion in the first skin, and the second flange portion is bonded with the second skin body portion in the second skin.

The glazing unit comprises one or more panes and has an edge disposed adjacent to, and between, the first tip and the second tip. The end of the first flange portion and the end of the second flange portion have complementary shapes and sizes, and are interconnected to provide an interlocking structure.

In some embodiments, the end of the first flange portion comprises a first protrusion. The end of the second flange portion defines a first recess for accepting the first protrusion, or vice versa. The first flange portion and the second flange portion are interconnected to form a male/female interlocking structure. In some embodiments, the end of the second flange portion has at least one portion comprising a second protrusion. The end of the first flange portion has a corresponding portion defining a second recess for accepting the second protrusion. The first flange portion and the second flange portion are interconnected through alternating male/female interlocking structures. Each of the skins defines an opening in its planar body portion for receiving the glazing unit. The openings may have a same size. The two skins combined also define an opening for the glazing unit. These interlocking structures exist around the edge of the openings in some embodiments.

In some embodiments, an adhesive is disposed between the end of the first flange portion and the end of the second flange portion in the interlocking structure. In some other embodiments, the interlocking structure is mechanically formed. In some embodiments, the first flange portion and the second flange portion for the interlocking structure comprises a material selected from the group consisting of a fiber glass polymer composite, a polymer (e.g., PVC), a metal, wood, and any combination thereof.

In some embodiments, the first flange portion of the first skin is substantially normal to the first skin body portion. The second flange portion of the second skin is also substantially normal to the second skin body portion.

In some embodiments, the door further comprises a tape or a film disposed between the glazing unit and the first tip of the first skin body portion or the second tip of the second skin body portion. Each of the first skin and the second skin comprises or is made entirely of a glass fiber filled polymer (e.g., polyester) composite in some embodiments.

In some embodiments, each of the first skin and the second skin has an inner surface defining a groove for accepting an adhesive or sealant, which bonds or seals one portion of the skin with the corresponding portion of the panes in the glazing unit.

The door may also comprise two stiles and two rails. The door may have a rectangular shape. The two stiles are aligned vertically along two vertical edges of the door, and the two rails are aligned horizontally along two horizontal edges of the door. The two skins may be bonded to the rails and stiles. However, in some embodiments, the edge of the glazing unit is disposed adjacent to and between the first tip and the second tip without an external frame member for connecting each of the first skin, the second skin, and the glazing unit.

In some embodiments, the glazing unit comprises multiple panes comprising or made of inorganic or organic glass, or a combination thereof. For example, the glazing may comprise two panes, and a spacer between the two panes.

In some embodiments, the door further comprises a foamed material, for example, polyurethane (PU) foam, disposed between the first skin and the second skin. The foamed material and the edge of the glazing unit are disposed on two sides separated by the interlocking structure.

A kit for making a door as described herein also is disclosed. Such a kit comprises a first skin, a second skin, and a glazing unit. The kit may also comprise two stiles and two rails. The first skin includes a first skin body portion providing a first outer door surface, and a first flange portion connected with and extending inward from the first skin body portion. The first skin body portion has a first tip. The second skin includes a second skin body portion providing a second outer door surface, and a second flange portion connected with and extending inwardly from the second skin body portion. The second skin body portion has a second tip. Each flange portion may be unitarily molded with a respective skin or bonded onto the skin as described. The glazing unit includes one or more panes, and has an edge shaped and sized to be disposed adjacent to and between the first tip and the second tip. The end of the first flange portion and the end of the second flange portion have complementary shapes and sizes and are configured to be interconnected to provide an interlocking structure in the interior space between the two skins.

In some embodiments, the end of the first flange portion comprises a first protrusion. The end of the second flange portion defines a first recess for accepting the first protrusion. The first flange portion and the second flange portion are configured to be interconnected to provide a male/female interlocking structure. In some embodiments, the end of the second flange portion has at least one portion comprising a second protrusion. The end of the first flange portion has a corresponding portion defining a second recess for accepting the second protrusion. The first flange portion and the second flange portion are configured to be interconnected to provide alternating male/female interlocking structures.

In some embodiments, the kit further comprises tape. The tape is shaped and sized to be disposed between the glazing unit and the first tip of the first skin body portion or the second tip of the second skin body portion.

In another aspect, the present disclosure provides a skin structure for a door. The skin structure comprises a first skin including a first skin body portion providing a first outer door surface and a first flange portion connected with and extending inwardly from the first skin body portion. An end of the first flange portion has a first protrusion. The skin structure may further comprise a second skin including a second skin body portion providing a second outer door surface and a second flange portion connected with and extending inwardly from the second skin body portion. An end of the second flange portion has a first recess. The first protrusion is configured to be disposed within the first recess thereby forming at least a first portion of an interlocking structure. In some embodiments, the end of the second flange portion includes a second protrusion, and the end of the first flange portion defines a second recess. The second protrusion configured to be disposed within the second recess thereby forming at least a second portion of the interlocking structure. The present disclosure also provides an assembled skin structure as described.

In another aspect, the present disclosure provides a method for making a door as described herein. The method comprises steps of providing a first skin as described, providing a second skin as described. The end of the first flange portion and the end of the second flange portion have complementary shapes and sizes. The method further comprises a step of installing a glazing unit including one or more panes. The glazing unit has an edge disposed adjacent to and between the first tip and the second tip. The method further comprises a step of connecting the first skin and the second skin to provide an interlocking structure.

In some embodiments, the first or second skin is provided by molding the first or second skin, including the respective skin body portion and the respective flange portion, in a unitary structure. In some embodiments, the step of providing the first or second skin comprises molding the respective skin body portion and the respective flange portion separately, and bonding the respective flange portion onto the respective skin body portion.

In some embodiments, each of the first skin and the second skin is molded in a molded prototype comprising an extra piece connected with the first or the second tip, and the extra piece is removed after molding. For example, each skin body of the respective skin includes a molded middle portion that is later cut out to define an opening for accepting the glazing unit. In some other embodiments, each skin is molded with such an opening.

In some embodiments, the method further comprises applying a tape between the glazing unit and the first tip of the first skin body portion or the second tip of the second skin body portion. The tape may have a portion between each tip and the surface of a glazing unit, and another portion extending outside the tip. Such a method may further comprise painting the first or second skin, and peeling off the portion of the tape disposed on the glazing unit outside the first or second tip. The portion of the tape between the tip and the glazing unit remains in place after the removal of the excess tape. The step for assembling the steps may be performed in by a door manufacturer. The steps of painting and peeling off the exposed tape may be done by the customers who have purchased the door. The method may also comprise steps of assembling stiles and rails, and bonded skins to the stiles and rails.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion. Like reference numerals denote like features throughout specification and drawings.

The attached design drawings illustrate exemplary doors in accordance with some embodiments.

FIG. 2B shows an exemplary second skin, and FIG. 2C shows an exemplary first skin.

FIG. 3B illustrates an enlarged detail of such an exemplary interlocking structure.

DETAILED DESCRIPTION

Figure 1:
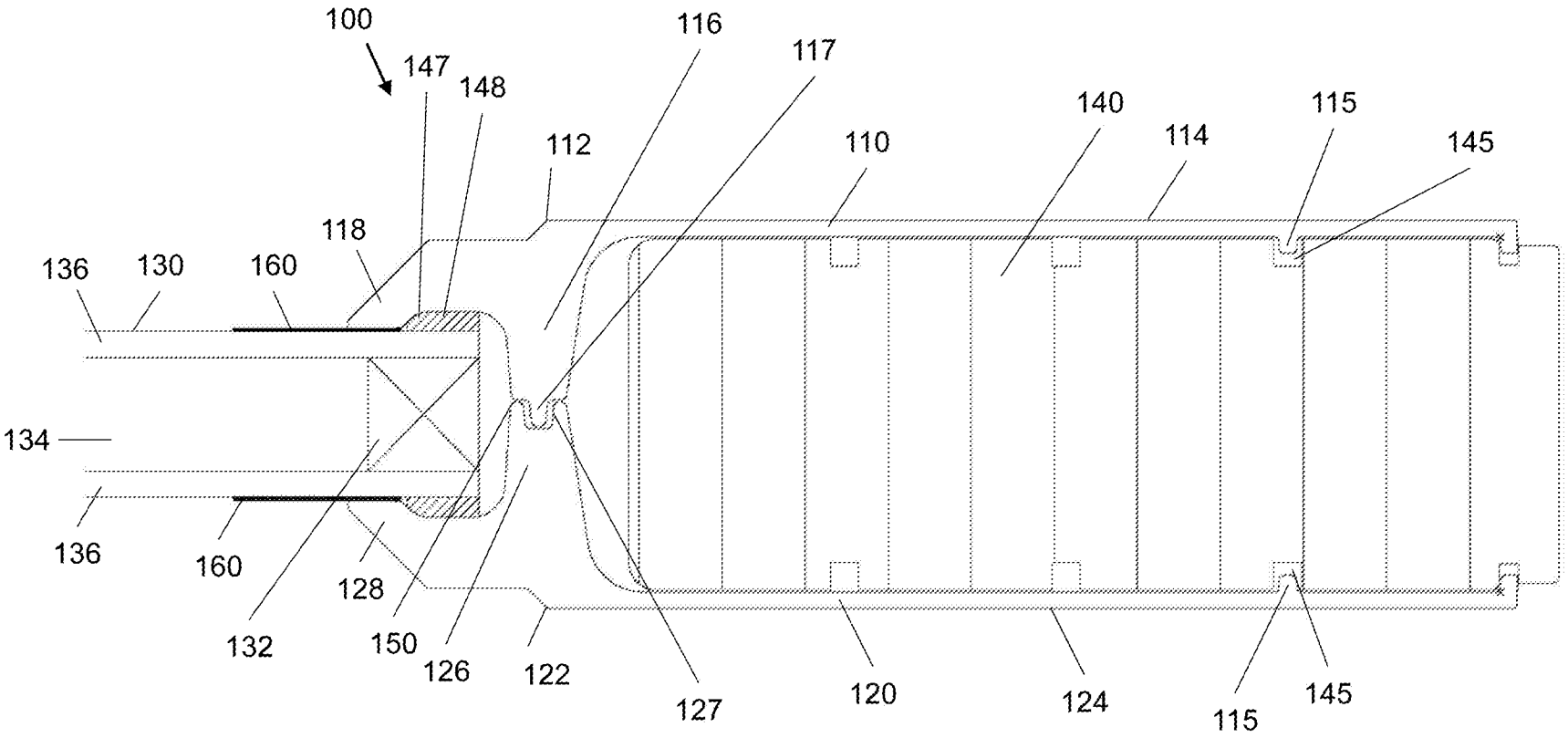
FIG. 1 is a sectional view illustrating an exemplary door in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In the present disclosure the singular forms "a," "an," and "the" include the plural reference, and reference to a particular numerical value includes at least that particular value, unless the context clearly indicates otherwise. Thus, for example, a reference to "an interlocking structure" is a reference to one or more of such structures and equivalents thereof known to those skilled in the art, and so forth. When values are expressed as approximations, by use of the antecedent "about," it will be understood that the particular value forms another embodiment. As used herein, "about X" (where X is a numerical value) preferably refers to ±10% of the recited value, inclusive. For example, the phrase "about 8" preferably refers to a value of 7.2 to 8.8, inclusive; as another example, the phrase "about 8%" preferably (but not always) refers to a value of 7.2% to 8.8%, inclusive. Where present, all ranges are inclusive and combinable. For example, when a range of "1 to 5" is recited, the recited range should be construed as including ranges "1 to 4", "1 to 3", "1-2", "1-2 & 4-5", "1-3 & 5", "2-5", and the like. In addition, when a list of alternatives is positively provided, such listing can be interpreted to mean that any of the alternatives may be excluded, e.g., by a negative limitation in the claims. For example, when a range of "1 to 5" is recited, the recited range may be construed as including situations whereby any of 1, 2, 3, 4, or 5 are negatively excluded; thus, a recitation of "1 to 5" may be construed as "1 and 3-5, but not 2", or simply "wherein 2 is not included." It is intended that any component, element, attribute, or step that is positively recited herein may be explicitly excluded in the claims, whether such components, elements, attributes, or steps are listed as alternatives or whether they are recited in isolation.

Unless expressly indicated otherwise, references to "substantially normal (or perpendicular) to" made herein will be understood to encompass an intersection having an angle of about 90 degree, for example, in the range of from 81 to 99 degree.

References to "a glazing unit" made herein will be understood to encompass a unit comprising one or more panes or panels made of an inorganic glass, organic glass, or a combination thereof. A glazing unit is also known glazings, glass inserts, lights, or lites.

The present disclosure provides a door comprising a glazing unit and a method of making the same. The present disclosure also provides a kit for making such a door. More particularly, the present disclosure provides a door comprising two skins, which form an interior interlocking structure.

The following descriptions are additional to the description in the Summary and the attached drawings. These do not exhaust the written descriptions based all the drawings. The door has an interlocking structure and optionally at least one tape disposed between the glazing unit (i.e., a unit comprising glass) and the skins. The exemplary embodiments are illustrated in the attached drawings.

For example, referring to FIG. 1, in some embodiments, a door 100 comprises two skins including a first skin 110, a second skin 120, and a glazing unit 130. Each of the skins 110, 120 has a main body portion in the form of the front or back surface of the exemplary door and a flange portion connected with the main body portion (i.e. the surface portion). The first skin 110 includes a first skin body portion 112 providing a first outer (e.g., exterior) door surface 114, and a first flange portion 116 connected with and extending inward from the first skin body portion 112. The first skin body portion has a first tip (or end) 118. The second skin 120 includes a second skin body portion 122 providing a second outer (e.g., exterior) door surface 124 and a second flange portion 126 connected with, and extending inwardly from, the second skin body portion 122. The second skin body portion 122 has a second tip 128. Each tip 118, 128 has a contact surface configured to hold and the glazing unit 130.

The glazing unit 130 comprises one or more panes 136 (or panels) and has an edge disposed adjacent to and between the first tip 118 and the second tip 128. The glazing unit 150 may include a spacer 132 and a void 134 between two adjacent glass panes 136. In some embodiments, the glazing unit 130 comprises multiple panes 136, which include or are made of inorganic or organic glass, or a combination thereof. For example, the glazing unit 130 may comprise two panes 136 and a spacer 132 between the two panes 136.

In some embodiments, the glazed unit 130 may include a plurality of panes 136, including first and second panes, which establish the opposite first and second sides of the glazed unit 130. The glazed unit also may include a spacer 132 disposed between the first and second panes 136. The spacer 132 may extend adjacent each edge of the first and second panes 136. Each of the plurality of panes 136 comprises inorganic glass, organic glass, or a combination thereof. In some embodiments, each pane comprises or is made of silica or silicate based glass such as soda-lime glass. Unless expressly indicated otherwise, references to "organic glass" made herein will be understood to encompass unless any amorphous, solid, glasslike material made of transparent plastic, including but not limited to, polycarbonate, and polymethyl methacrylate (PMMA).

The first flange portion 116 and the second flange portion 126 have ends of complementary shapes and sizes, and are interconnected to provide an interlocking structure 150. For example, the flange portions 116, 126 of the two skins 110, 120 face each other and form a male-female interlocking structure 150. On the other side of the interlocking structure 150 opposite to the glazing unit 130, the main body portions 112, 122 and the flange portions 116, 126 form a cavity, which is filled with a foamed material 140. Each of the skins 110, 120 may have interior ribs or studs 115 on the interior surfaces protruding into cavities 145 defining by the foamed material 140. In some embodiments, the foamed material 140 is made of polyurethane (PU) foam, which is disposed between the first skin 110 and the second skin 120. The foamed material 140 and the glazing unit 130 are disposed on two sides separated by the interlocking structure 150.

Each of the flange portion 116, 126 may be unitarily molded with a respective skin 110, 120 or bonded onto the skin 110, 120. In some embodiments, the first skin 110 including the first skin body portion 112 and the first flange portion 116 is a unitary molded structure. The second skin 120 including the second skin body portion 122 and the second flange portion 126 is a unitary molded structure. In some other embodiments, each respective flange portion 116, 126 and the respective skin body portion 112, 122 may be molded separately and then bonded together. The first flange portion 116 is bonded with the first skin body portion 112 in the first skin 110, and the second flange portion 126 is bonded with the second skin body portion 122 in the second skin 120.

In some embodiments, the first flange portion 116 and the second flange portion 126 for the interlocking structure 150 comprise a material selected from the group consisting of a fiber glass polymer composite, a polymer (e.g., PVC), a metal, wood, and any combination thereof.

In some embodiments, each of the first skin 110 and the second skin 120 has an inner surface defining a groove 147 for accepting an adhesive or sealant 148, which bonds or seals one portion of the skin with the corresponding portion of the panes 136 in the glazing unit 130. As shown in FIG. 1, the adhesive or sealant 148 may be also disposed between the first or second flange portion 116, 126 and the glazing unit 130. In some embodiments, an adhesive or sealant 148 is disposed between the end of the first flange portion 116 and the end of the second flange portion 126 in the interlocking structure 150. The adhesive or sealant 148 is cured in an assembled door. In some embodiments, the interlocking structure 150 is mechanically formed without any adhesive or sealant between the first and the second flange portion 116, 126.

Figure 2A:
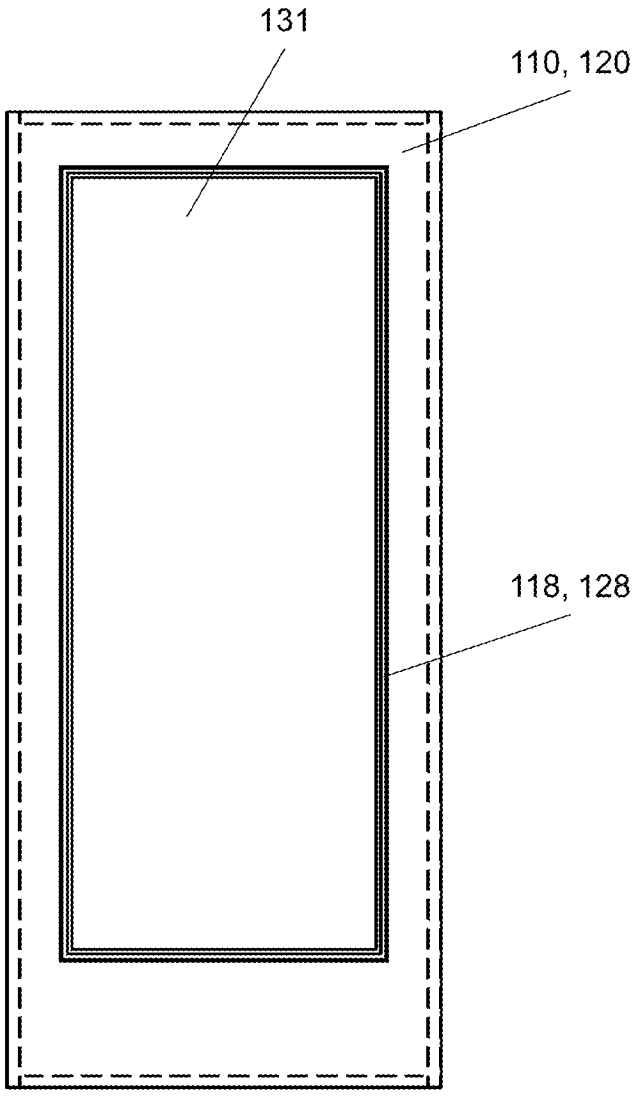
FIG. 2A is a plan view illustrating exemplary skins (or door) in accordance with some embodiments.

Referring to FIG. 2A, each of the skins 110, 120 defines at least one opening 131 in its planar body portion for receiving and/or exposing the glazing unit 130. In some embodiments, the openings 131 in the skins 110, 120 have a same size. The two skins 110, 120 combined also define an opening 131 for the glazing unit 130 at the tips 118, 128.

Figure 2B:
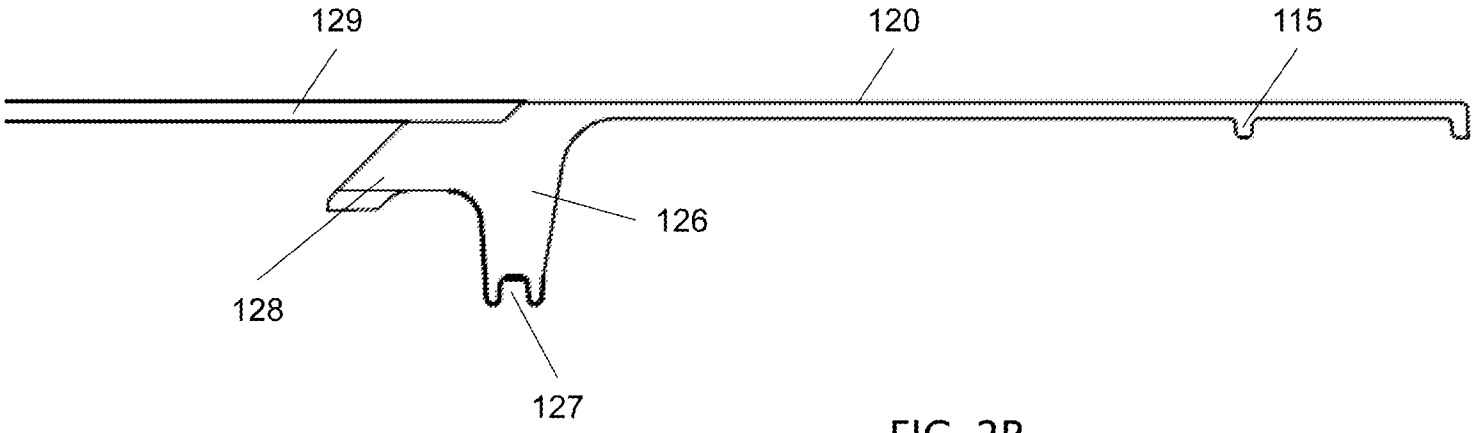
FIGS. 2B-2C are sectional views illustrating an exemplary first skin and an exemplary second skin in accordance with some embodiments.
Figure 2C:
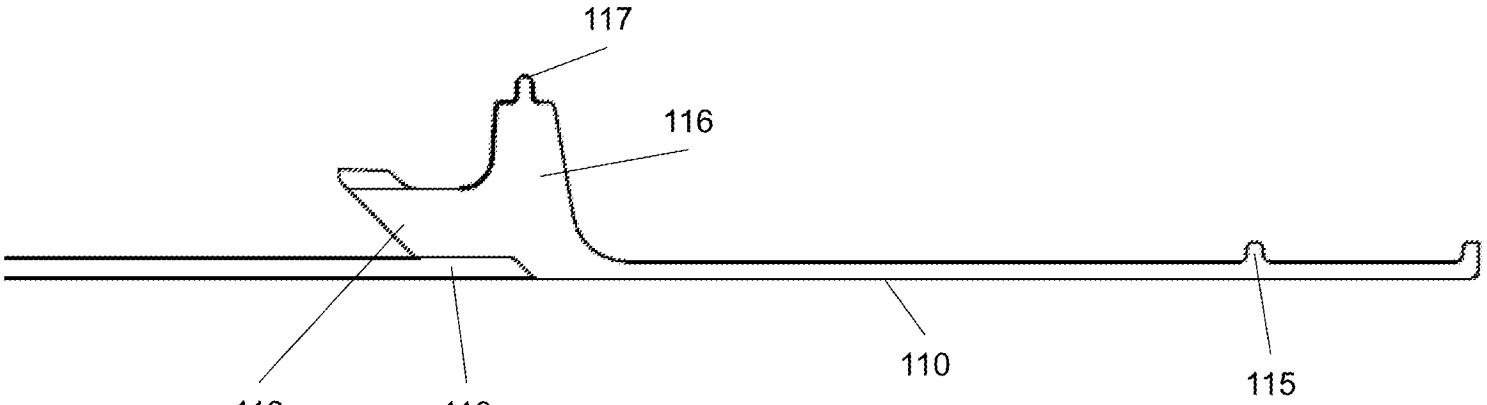

FIGS. 2B-2C illustrate an exemplary first skin 110 (FIG. 2C) and an exemplary second skin 120 (FIG. 2B) in accordance with some embodiments. As illustrated in FIGS. 2B-2C, first skin 110 may optionally include an additional portion 119 after being molded, and the second skin 120 may optionally include an additional portion 129 after being molded. The additional portions 119, 129 may be cut and removed from the skins 110, 120 before the skins 110, 120 and the glazing unit 130 are assembled.

Figure 3A:
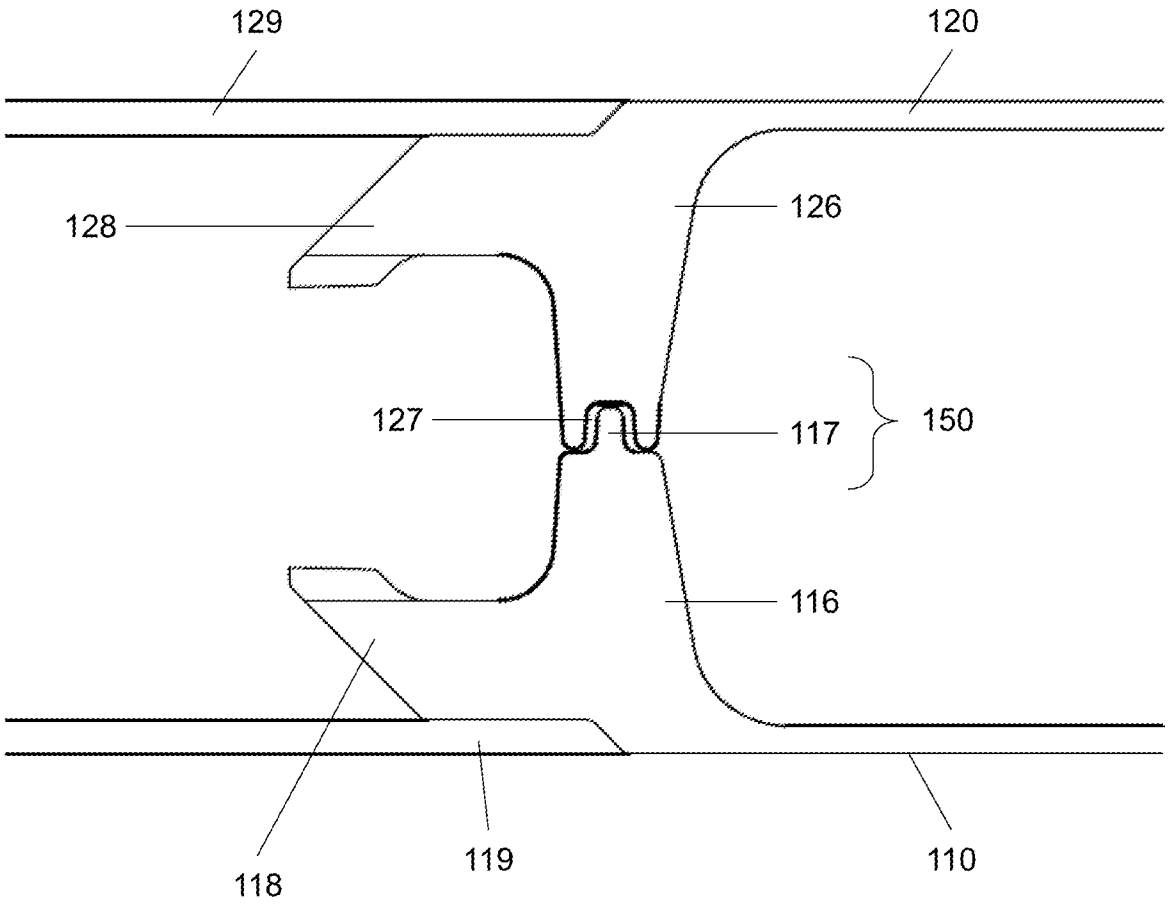
FIGS. 3A-3B are sectional views illustrating an exemplary interlocking structure formed by a first skin and a second skin in accordance with some embodiments.
Figure 3B:
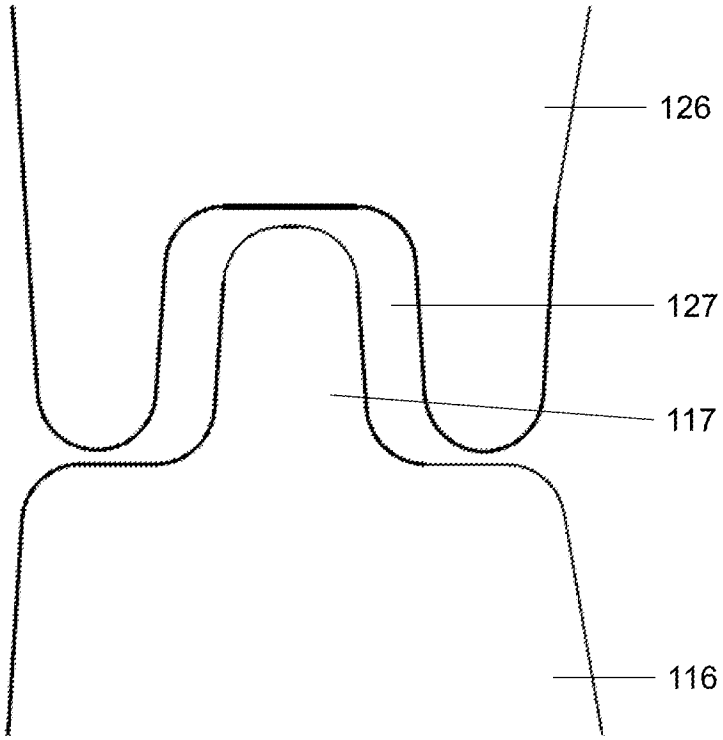

Referring to FIGS. 1, 2B-2C, and 3A-3B, in some embodiments, the first flange portion 116 comprises a first protrusion 117, and the second flange portion 126 defines a first recess 127 for accepting the first protrusion 117, or vice versa. The first flange portion 116 and the second flange portion 126 can be interconnected during assembly to form the male/female interlocking structure 150 as illustrated in FIGS. 1 and 3B.

Figure 3C:
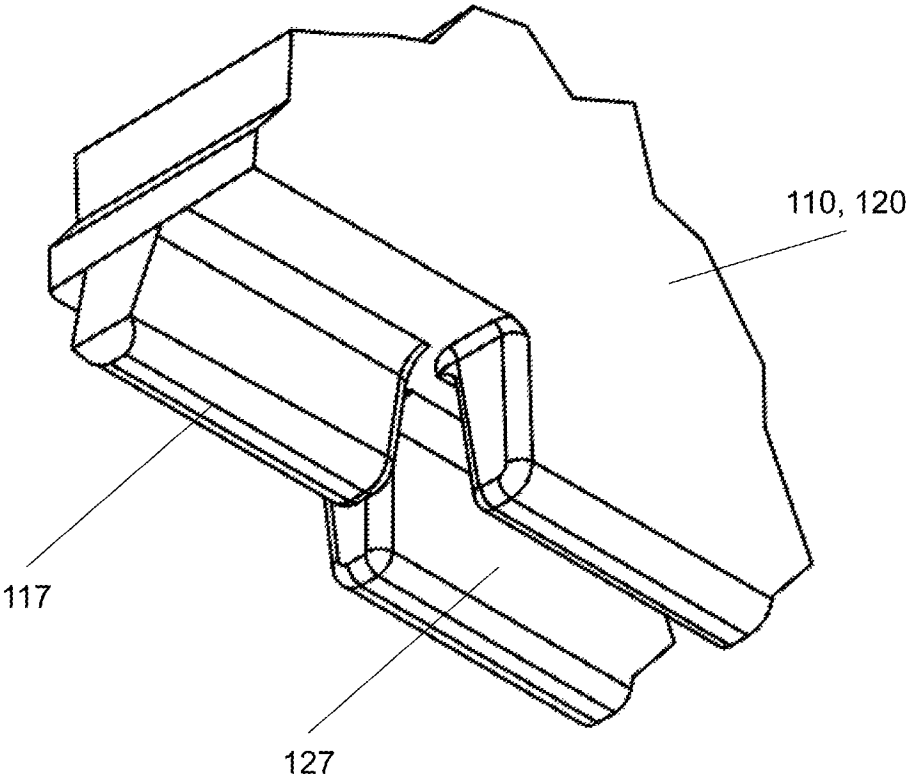
FIG. 3C is a perspective view illustrating an exemplary skin having both male and female flange portions in accordance with some embodiments.

Referring to FIG. 3C, in some embodiments, each flange portion of the skins 110, 120 comprises both protrusion 117 and recess 127, which match with each other along edges of the skins 110, 120 defining the opening 131 for the glazing unit 150. For example, the second flange portion 126 also has at least one portion comprising a second protrusion 117. The first flange portion has a corresponding portion defining a second recess 127 for accepting the second protrusion. The first flange portion 116 and the second flange portion 126 are interconnected through alternating male/female interlocking structures 150. These interlocking structures 150 exist around the edge of the openings 131 in some embodiments.

Referring to FIGS. 1, 2B-2C, and 3A-3C, in some embodiments, the first flange portion 116 of the first skin 110 is substantially normal to the first skin body portion 112. The second flange portion 126 of the second skin 120 is also substantially normal to the second skin body portion 122. In some embodiments, each skin 110 or 120 has a large central opening 131 with an inwardly directed flange 116 or 126 extending normal to its planar surface 114 or 124. The openings 131 have the same size, slightly smaller than the size of glass panes 136. The two skins 110, 120 may be placed parallel to each other during assembly. In some embodiments, the skins 110, 120 may be cut out to have two or three openings 131. One of ordinary skill in the art will understand that the number of cutouts may vary.

Figure 4A:
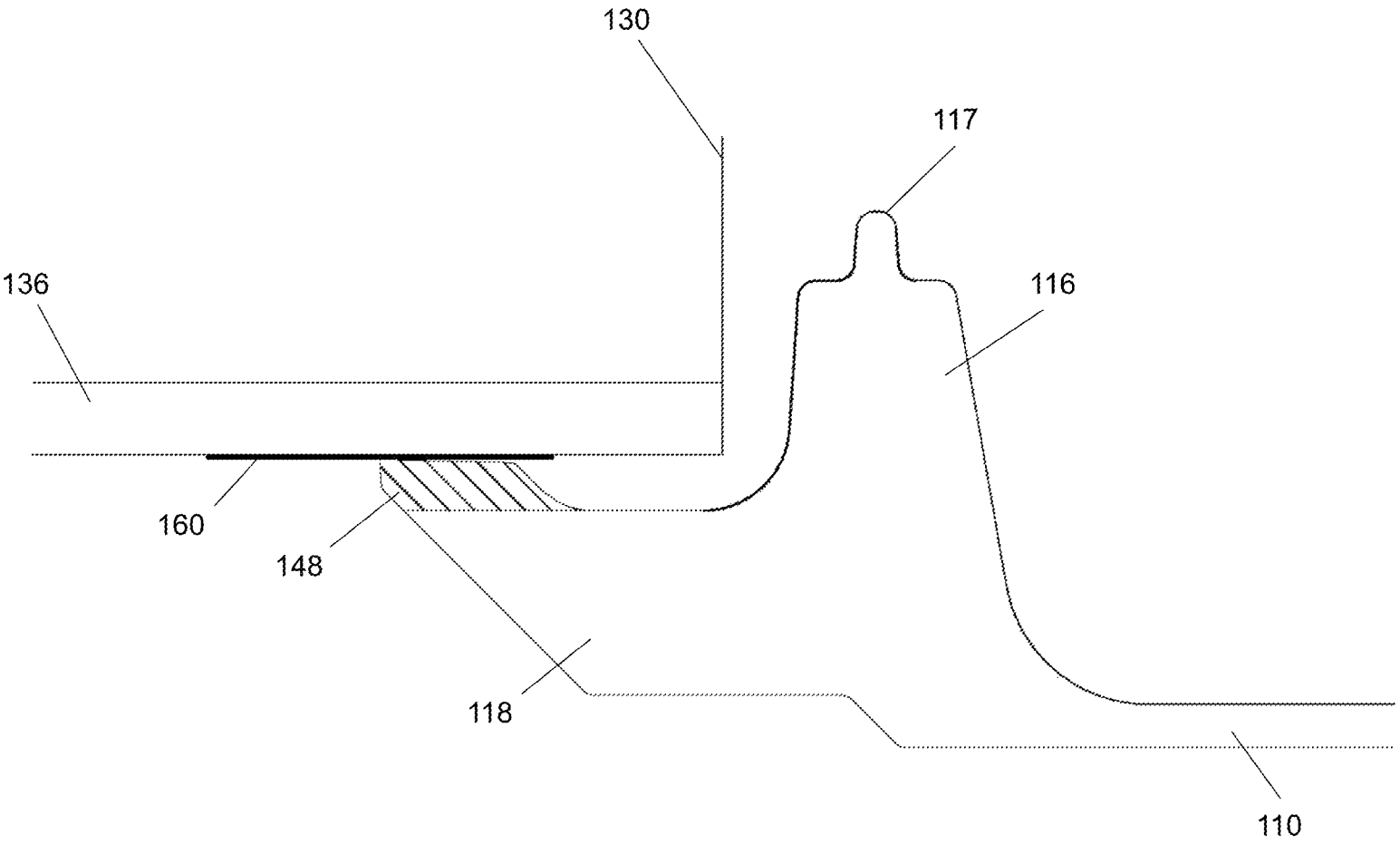
FIGS. 4A-4B are sectional views illustrating an exemplary glazing unit assembled with an exemplary first skin and an exemplary second skin, respectively, in accordance with some embodiments.
Figure 4B:
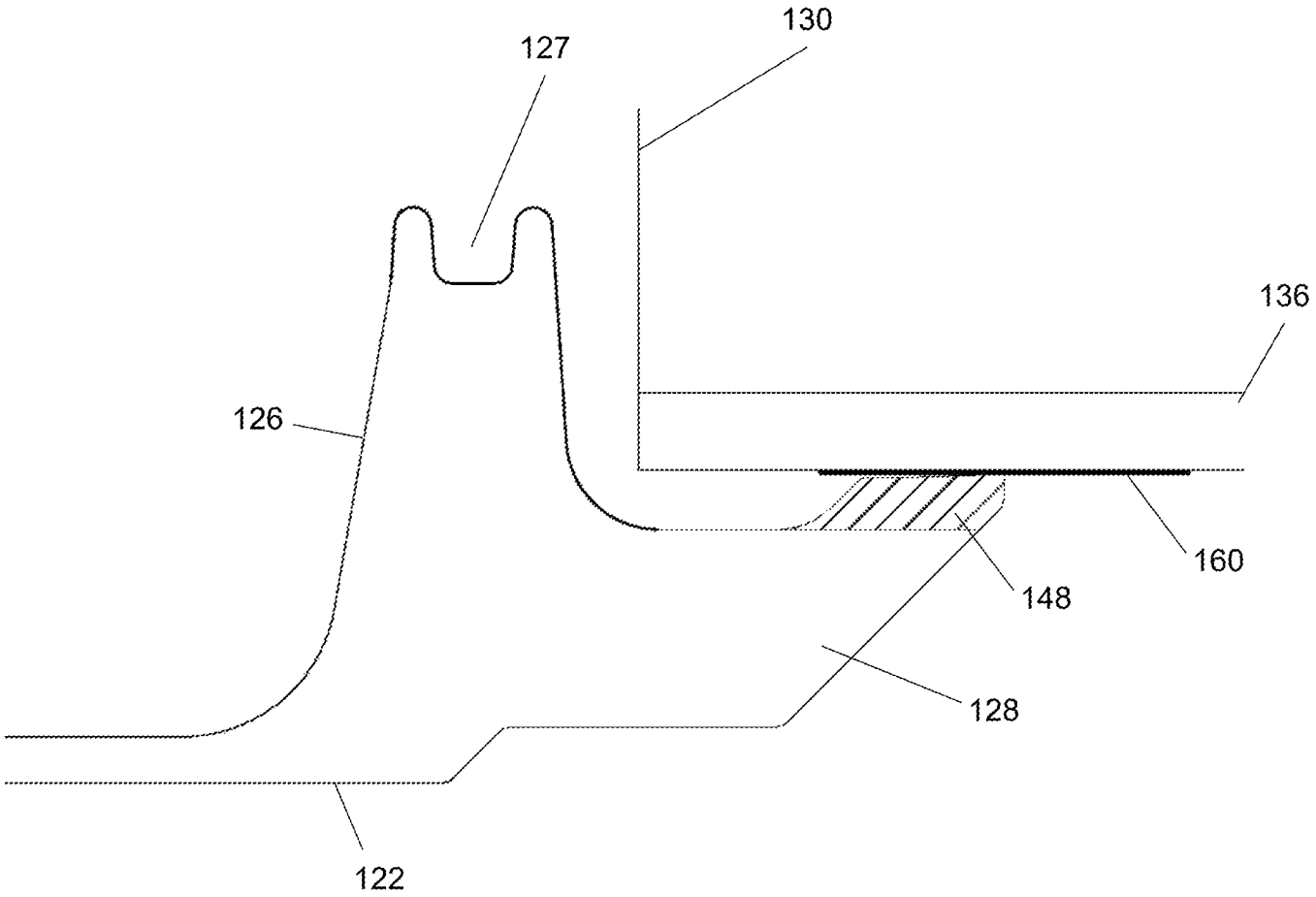

In some embodiments, the glazing unit 130 directly contacts the tips of the skins 110, 120. Tape 160 may be optionally disposed between each contact surface of a tip 118 or 128 and a surface of a glass panel 136 so that the tip 118 or 128 does not directly contact any glass panel 136 in the glazing unit 130. Referring to FIGS. 1 and 4A-4B, in some embodiments, the door 100 further comprises tape or film 160 disposed between the glazing unit 130 and the first tip 118 of the first skin body portion 112 or the second tip 128 of the second skin body portion 122. Each of the first skin 110 and the second skin 120 comprises or is made of a glass fiber filled polymer (e.g., polyester) composite in some embodiments.

The tape or film 160 may be made of any suitable materials. A moisture resistant tape or film may be preferred. For example, a suitable masking tape 160 is SCOTCH® solvent resistant masking tape 226 with a thickness of 0.0098" and a width of 0.75", available from 3M. During the manufacturing process, the masking tape 160 can be applied onto a glass panel partially covered by the tip of a skin, and later the portion of the tape 160 outside the skin is cut and peeled off from the glass panel. The portion of the tape 160 disposed between the contact surface of the tip and a surface of the glass panel is maintained in the final door.

In some embodiments, the glass panes 136 exposed outside are covered with a masking or protective film 160. The entire exposed glass surface up to and under the glass stop area may be covered with a masking or protective film 160. The tape or film is for pre-masking the glass before painting in assembly in some embodiments. A foam glazing tape may be also used on the exposed glass surface and/or between the tips 118, 128 and the panes 136 in some embodiments.

Figure 5A:
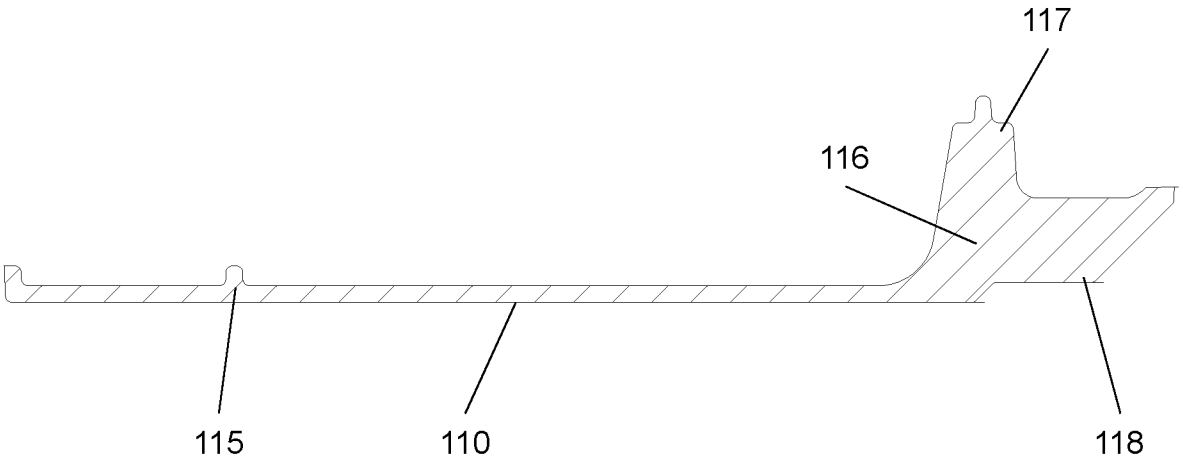
FIGS. 5A-5C are sectional views illustrating an exemplary method for making a door in accordance with some embodiments.
Figure 5B:
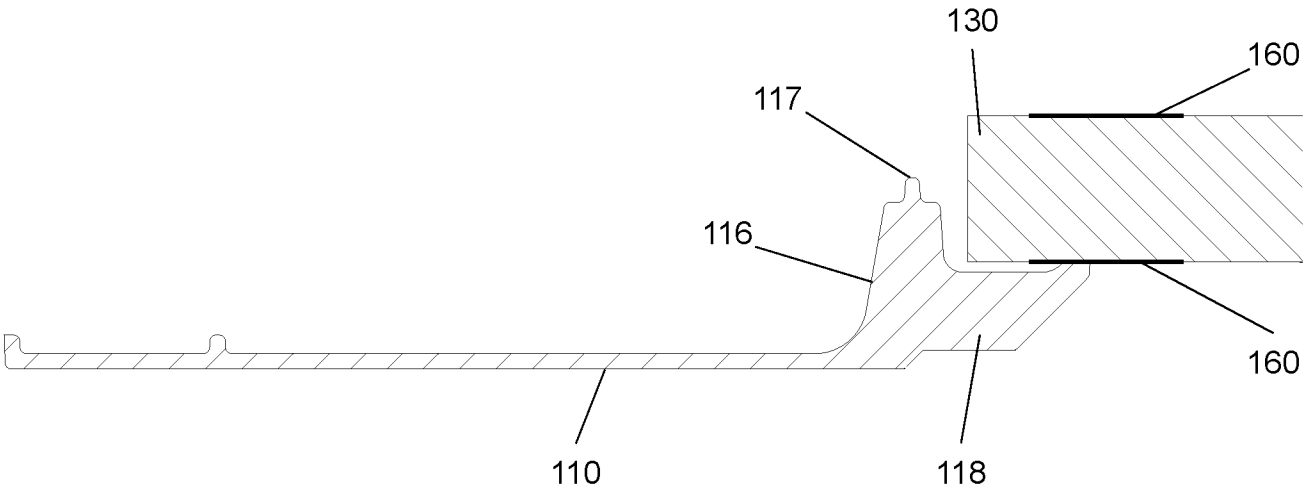
Figure 5C:
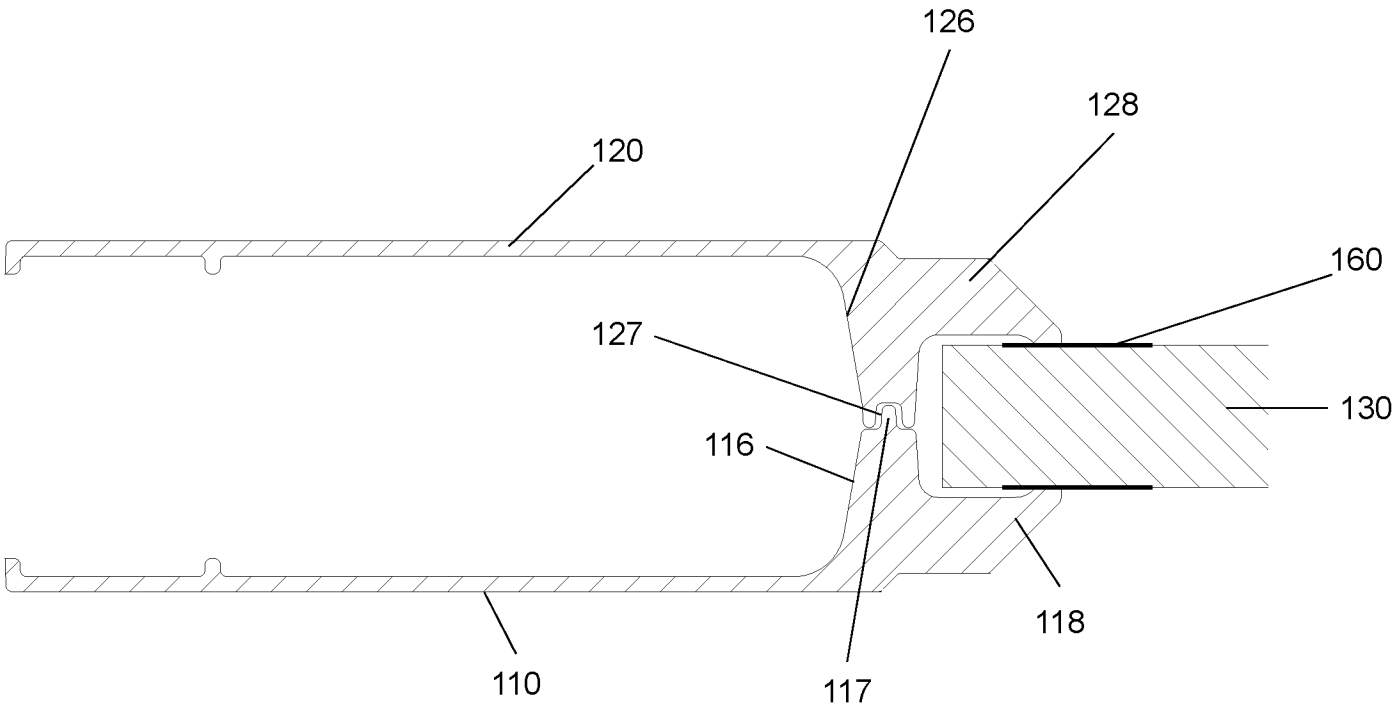

FIGS. 5A-5C illustrate one example of a method for making a door 100 in accordance with some embodiments.

Referring to FIG. 5A, a first skin 110 as described is provided. For example, the first skin 110, including the first skin body portion 112 and the first flange portion 116, is molded as a unitary structure. Similarly, a second skin 120 as described is provided. The second skin 120, including the first skin body portion 122 and the second flange portion 126, is molded as a unitary structure. The end of the first flange portion 116 and the end of the second flange portion 126 have complementary shapes and sizes for an interlocking structure 150.

Referring to FIG. 5B, a glazing unit 130 is coupled to the first skin 110. Adhesive or sealant 148 and one or more pieces of tape of film 160 as described above may be optionally applied.

Referring to FIG. 5C, the second skin 120 is applied and assembled with the first skin 110 and the glazing unit 130. The glazing unit 130 is disposed adjacent to, and between, the first tip 118 and the second tip 128 of the skins 110, 120, respectively. The first skin 110 and the second skin 120 are connected to provide the interlocking structure 150, through the structures such as protrusion 117 and recess 127 as described above.

Referring to FIGS. 5A-5C, in some embodiments, the first or second skin 110, 120 is provided by molding the first or second skin 110, 120, including the respective skin body portion 112, 122 and the respective flange portion 116, 126, in a unitary structure. In some embodiments, providing the first or second skin 110, 120 comprises molding the respective skin body portion 112, 122 and the respective flange portion 116, 126 separately, and bonding the respective flange portion 116, 126 onto the respective skin body portion 112, 122 as described in FIGS. 6, 7A-7B, and 8A-8E.

Figure 6:
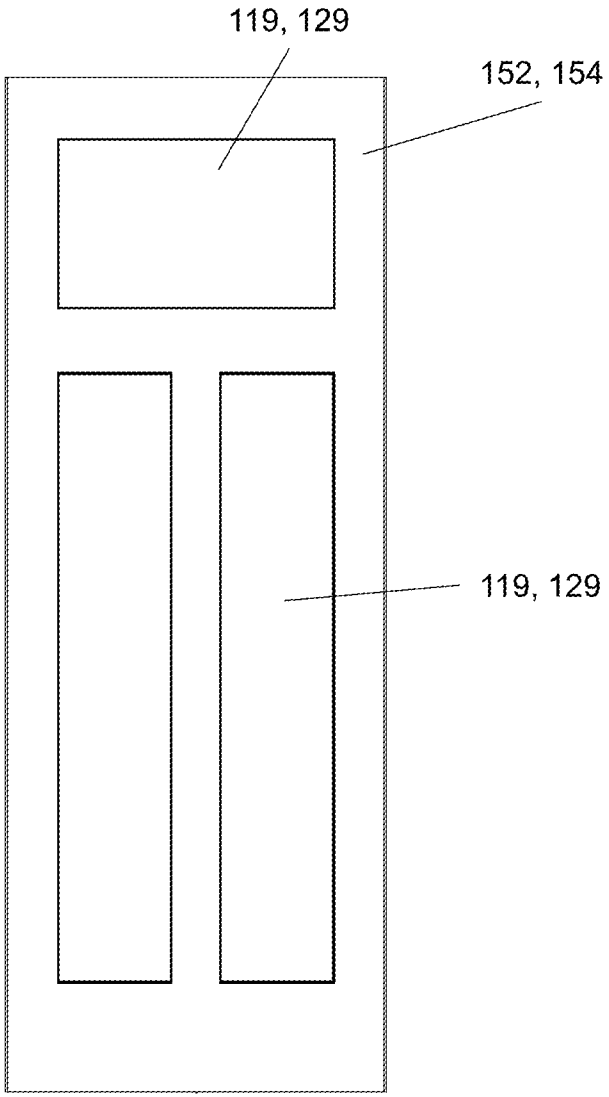
FIG. 6 is a plan view illustrating an exemplary door (or door skin) having three sections for glazing units in accordance with some embodiments.

Referring to FIG. 6, one example of a door is illustrated that may include two pre-molded skins 152, 154, which may include three sections 119, 129 for glazing units 130 in accordance with some embodiments. The two pre-molded skins 152, 154 may be skins for making opaque doors. The sections 119, 129 can be cut out to form the skin body portions 112, 122 having the openings 131 for installing glazing units 130.

Figure 7A:
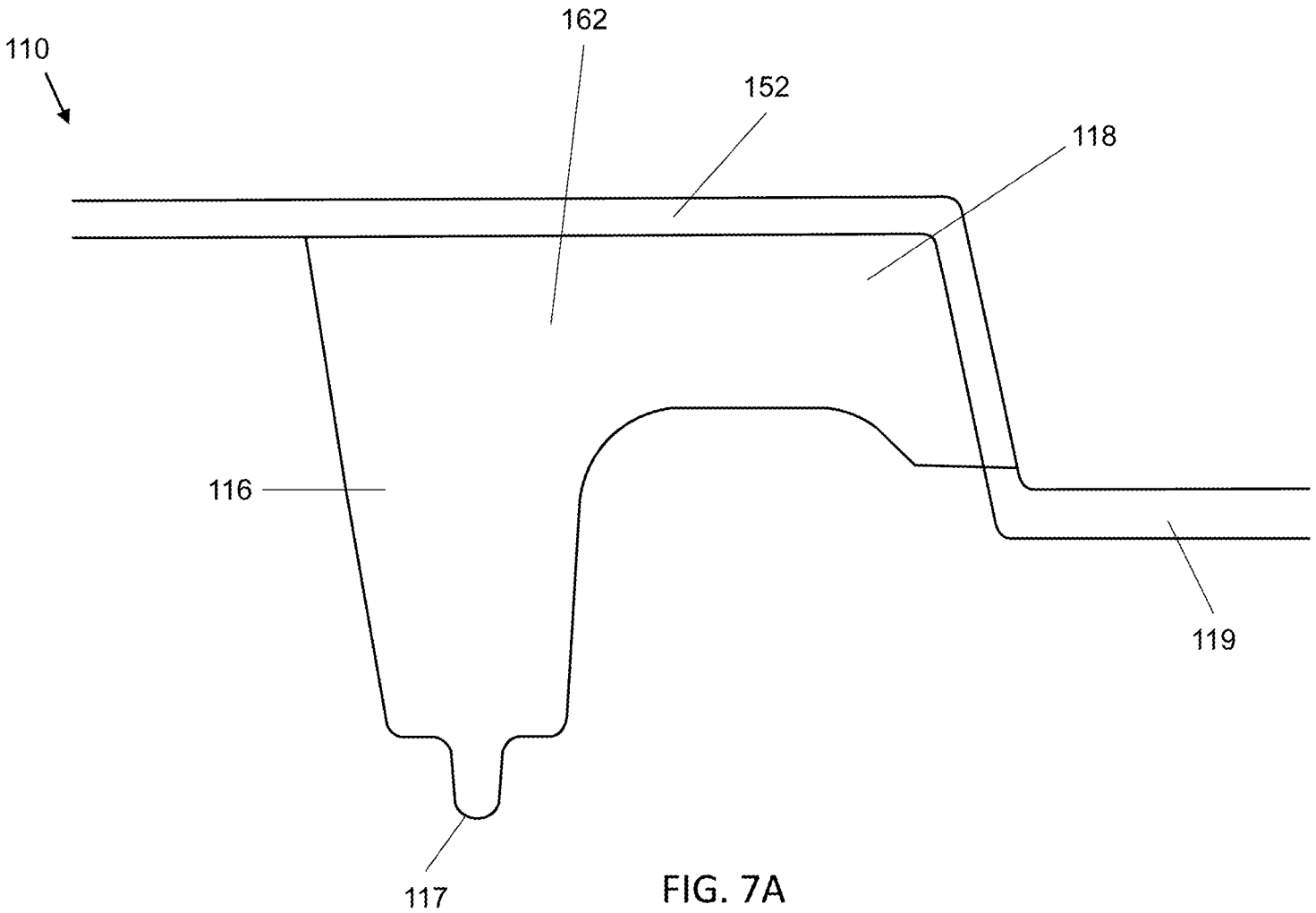
FIGS. 7A-7B are sectional views illustrating a flange portion molded separately and then bonded onto a molded skin body portion, which may be cut out before or after such a bonding process, in accordance with some embodiments.

Referring to FIGS. 6 and 7A, the first pre-molded skin 152 has three sections 119, which are cut out to define three openings 131. The resulting skin body portion 112 is bonded with a first pre-molded flange part 162, which is equivalent to the first flange portion 116 having a protrusion 117 as described above. The bonded structure is an exemplary first skin 110 in some embodiments. The sections 119 may be also cut out after such a bonding process.

Figure 7B:
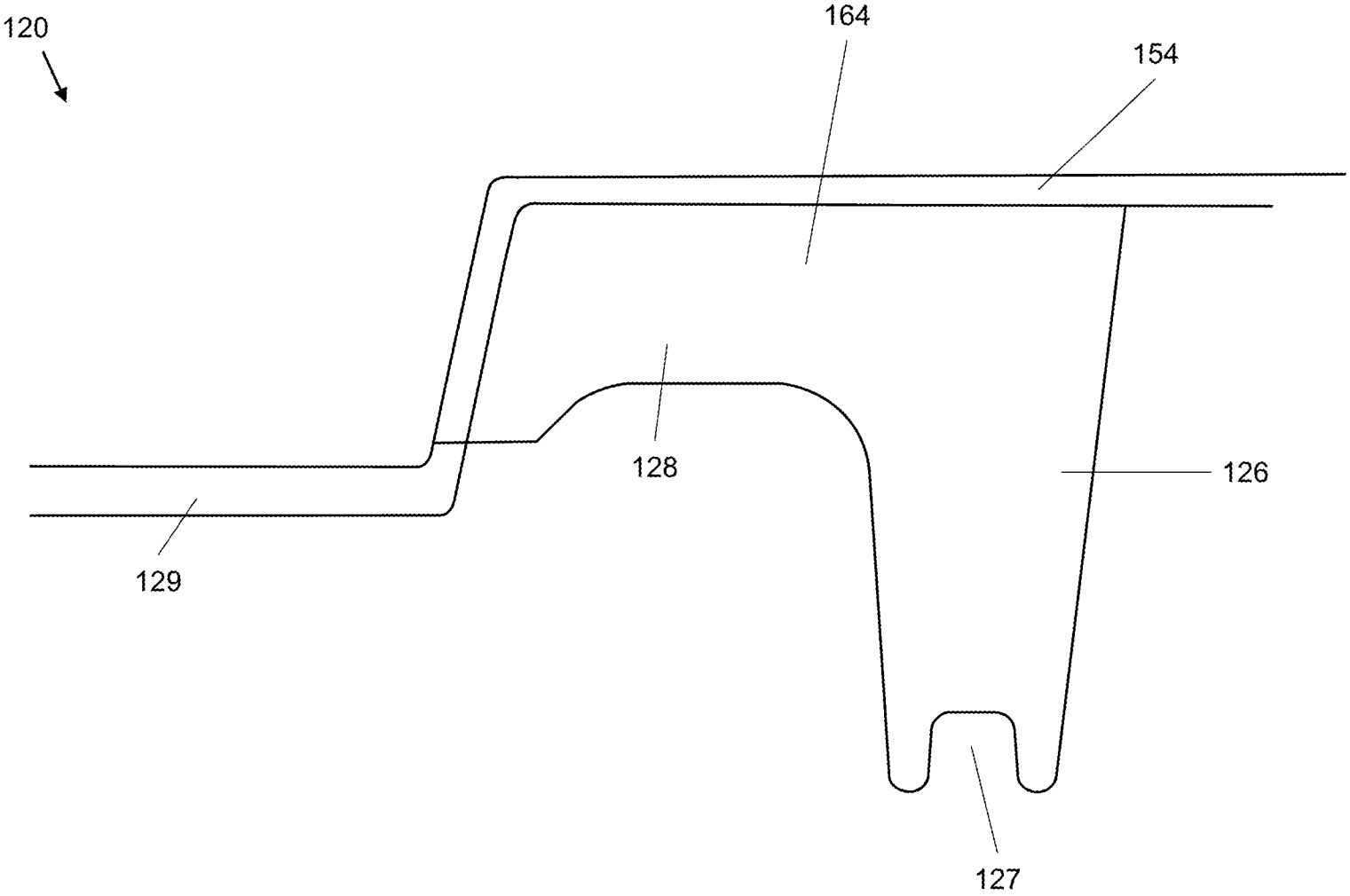

Referring to FIGS. 6 and 7B, the second pre-molded skin 154 has three sections 119, which are cut out to define three openings 131. The resulting skin body portion 122 is bonded with a second pre-molded flange part 164, which is equivalent to the second flange portion 126 having a recess 127 as described above. The bonded structure is an exemplary second skin 120 in some embodiments. The sections 119 may be also cut out after such a bonding process.

FIGS. 8A-8E illustrate an exemplary method for forming a door, in which flange portions are molded and then bonded onto corresponding skin body portion, in accordance with some embodiments.

Figure 8A:
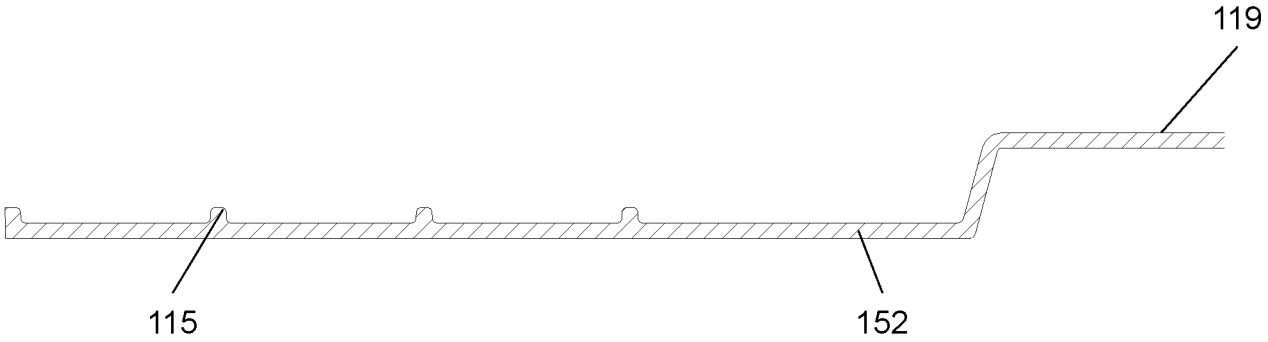
FIGS. 8A-8E are sectional view illustrating an exemplary method for forming a door, in which flange portions are molded and then bonded onto corresponding skin body portion, in accordance with some embodiments.
Figure 8B:
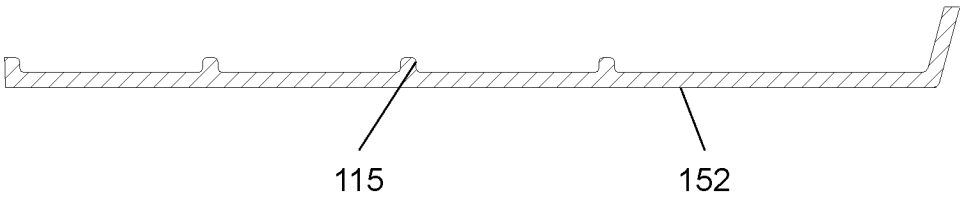

Referring to FIG. 8A, the first pre-molded skin 152 having at least one section 119 is provided. Referring to FIG. 8B, the section 119 is cut and removed to form an opening 131.

Figure 8C:
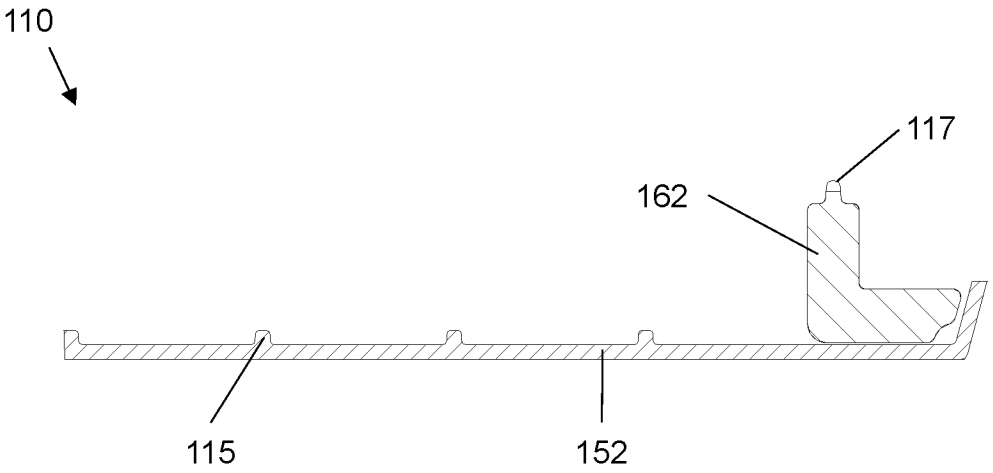

Referring to FIG. 8C, the first pre-molded flange part 162 is provided and bonded with the first pre-molded skin 152 to form the first skin 110. A second pre-molded skin 154 having at least one section 129 is provided. The section 129 can be cut and removed. The second pre-molded flange part 164 is provided and bonded with the second pre-molded skin 154 to form the second skin 120.

Figure 8D:
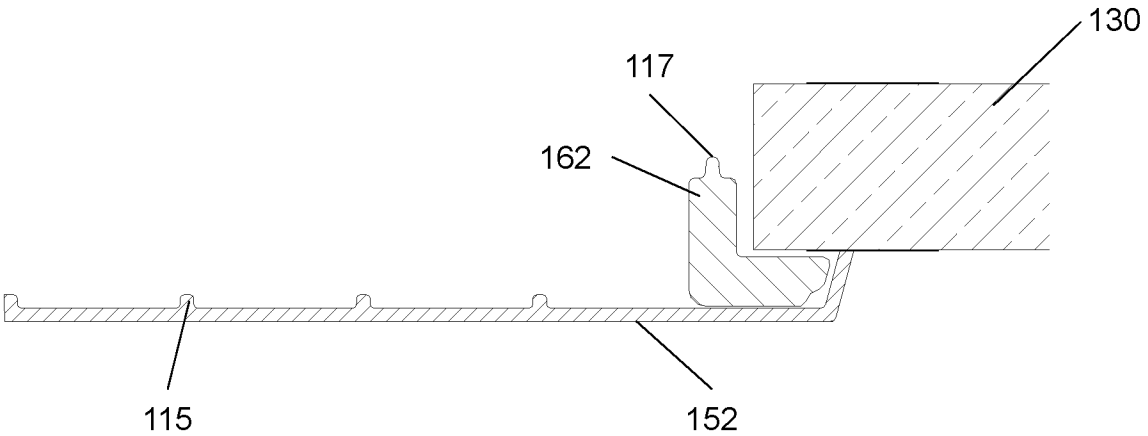

Referring to FIG. 8D, a glazing unit 130 is coupled to the first skin 110. Adhesive or sealant 148 and a piece of tape of film 160 as described above may be optionally applied.

Figure 8E:
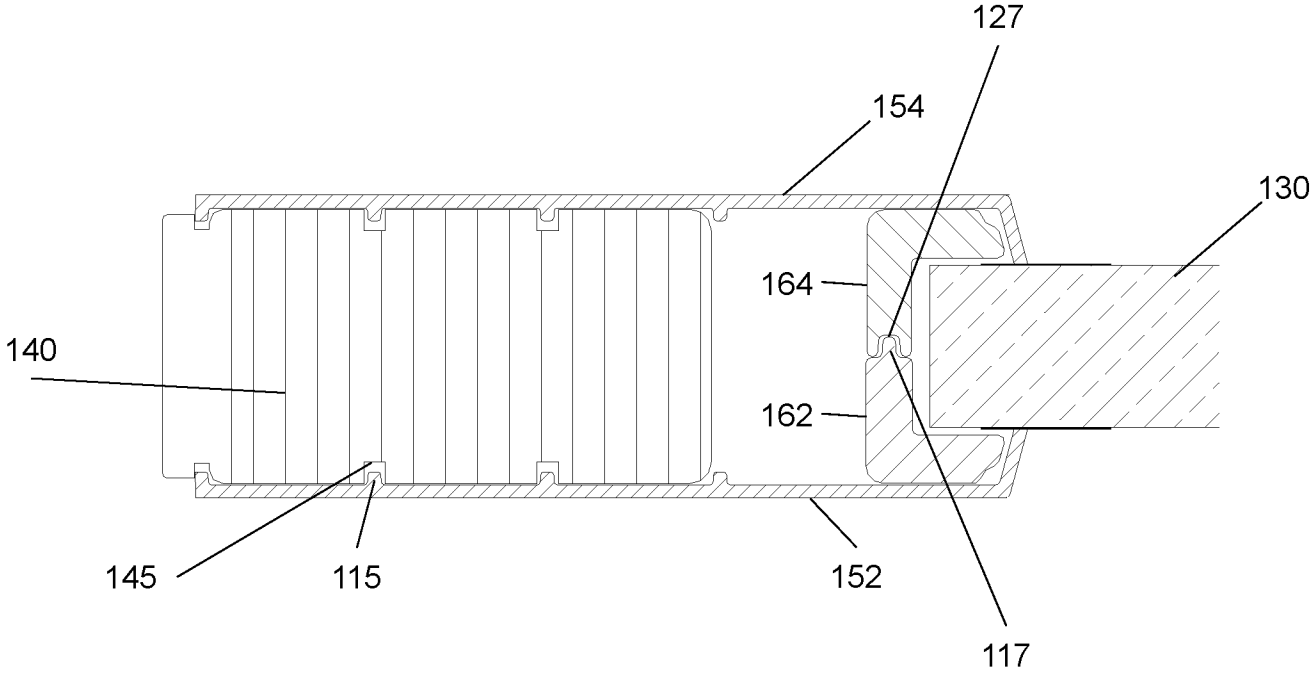

Referring to FIG. 8E, the second skin 120, which is formed by bonding the second pre-molded flange part 164 onto the second pre-molded skin 154, is applied and assembled with the first skin 110 and the glazing unit 130 to form a resulting door. The protrusion 117 and the recess 127 are interlocked together.

Figure 9:
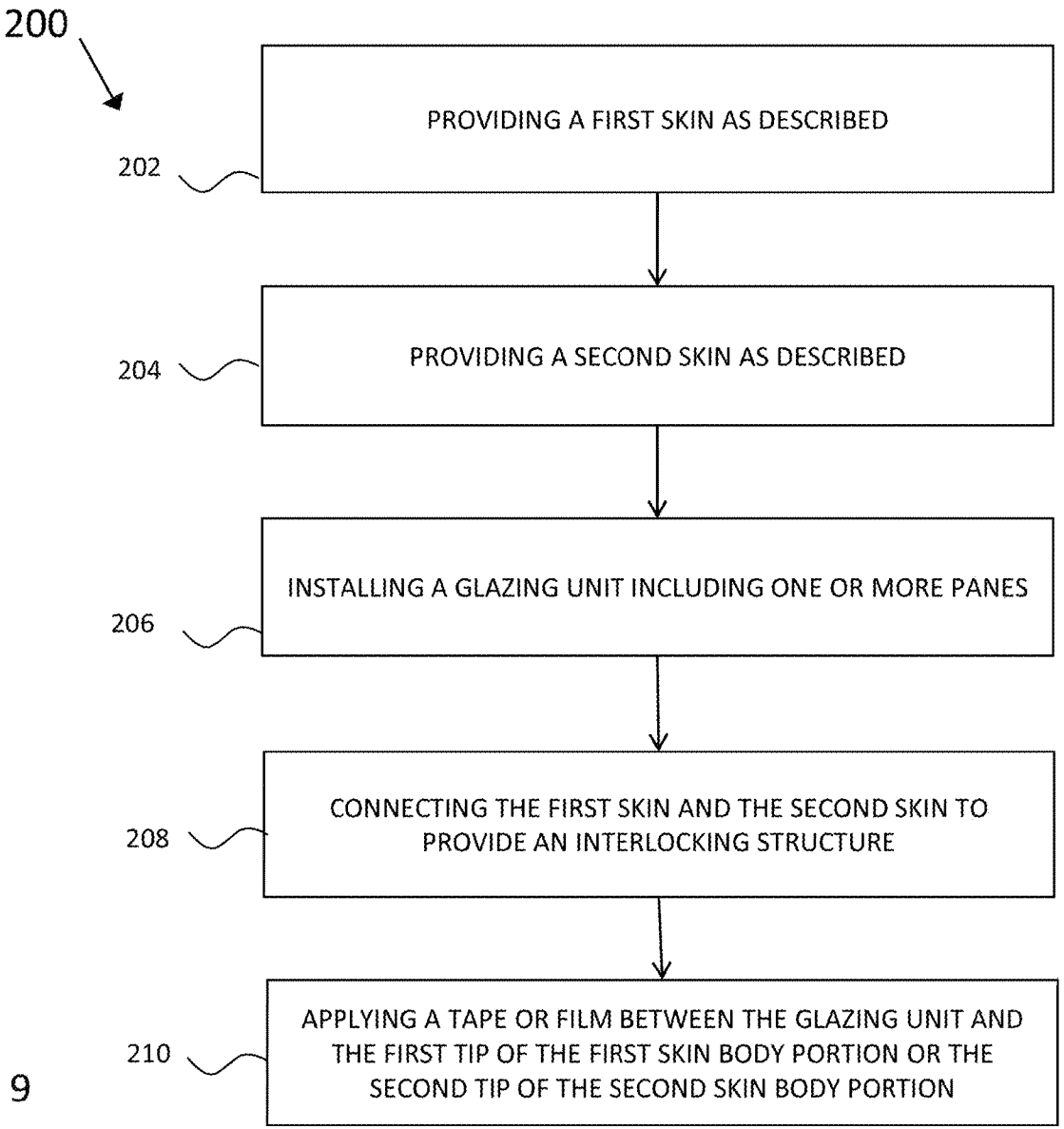
FIG. 9 illustrates an exemplary method for making a door in accordance with some embodiments.

FIG. 9 illustrates a flow chart of one example of a method 200 for making a door in accordance with some embodiments. The method 200 may be used to form doors as described above with respect to FIGS. 5A-5C and FIGS. 8A-8E.

At step 202, a first skin 110 having a first skin body portion 112 and a first flange portion 116 as described is provided.

At step 204, a second skin 120 having a second skin body portion 112 and a second flange portion 126 as described is provided. The end of the first flange portion 116 of the first skin 110 and the end of the second flange portion 126 of the second skin 120 have complementary shapes and sizes configured to form an interlocking structure 150.

Each flange portion may be unitarily molded with a respective skin or bonded onto the skin. In some embodiments, the first skin 110, including the first skin body portion 112 and the first flange portion 116, is a unitary molded structure, and the second skin 120, including the second skin body portion 122 and the second flange portion 126, is a unitary molded structure. Referring to FIGS. 5A-5C, in some embodiments, the first skin 110 or the second skin 120 is provided by molding such a skin including the respective skin body portion and the respective flange portion in a unitary structure. Each skin is molded with an opening 131 for accepting the glazing unit 130.

In some embodiments, each respective flange portion and the respective skin body portion may be molded separately and then bonded together. The first flange portion 116 is bonded with the first skin body portion 112 in the first skin 110, and the second flange portion 126 is bonded with the second skin body portion 122 in the second skin 120. Referring to FIGS. 8A-8E, in some embodiments, the first skin 110 or the second skin 120 is provided through molding the respective skin body portion and the respective flange portion separately and bonding them together.

In some embodiments, each of the first skin 110 and the second skin 120 is molded in a molded prototype comprising an extra piece 119, 129 connected with the first or the second tip, and the extra piece is removed after molded. For example, each skin body of the respective skin includes a molded middle portion that is later cut out to define an opening 131 for accepting the glazing unit 130.

In some embodiments, the door skins 110, 120 are opaque. Opaque door skins may be used for making other door products. In the present disclosure, the interlocking structure 150 can be used to convert opaque door skins to become the direct glaze glass skin. As described in FIGS. 8A-8E, after the glass area in the opaque skins are cut out, the glazing unit may be installed to become the direct glaze product. The same skins for the opaque doors are also used to make the direct glass glaze product without investing another direct glazing mold. By using this technology, the customers can choose any opening for the glass. For example, three panels may include one on the top and two on the bottom) may be cut to install glass. Any of the three panels may be selected.

At step 206, a glazing unit 130 including one or more panes 136 is installed. The glazing unit 130 has an edge disposed adjacent to and between the first tip 118 and the second tip 128 as described.

At step 208, the first skin 110 and the second skin 120 are connected to provide the interlocking structure 150.

In some embodiments, the method 200 may further comprise an optional step 210. At step 210, a tape or film 160 is applied between the glazing unit 130 and the first tip 118 of the first skin body portion 112 or the second tip 128 of the second skin body portion 122. The tape 160 may have a portion between each tip and the surface of a glazing unit 130, and another portion extending outside the tip.

The skins 110, 120 may be painted after the door is assembled. The portion of the tape 160 disposed on the glazing unit 130 but outside the tip 118 or 128 is then peeled off in some embodiments. The portion of the tape 160 between the tip 118 or 128 and the glazing unit 130 remains in place after the removal of the excess tape. The step for assembling the steps may be performed in by a door manufacturer. A customer purchasing and installing such a door may perform the steps of painting and peeling off the exposed tape. The tape or the film can help customers easily mask glass panes in their painting/staining processes easier. In existing products, it is difficult for customers to perform a complete masking a door product with direct glazed glass during painting/staining processes.

The tape or film may be applied during the manufacture of the door or during a production of making glass panes. For example, a glass panel may have a protective film placed on the glass. Such glass panels are available from Cardinal Corporation with Cardinal's "Preserve Film" disposed thereon. The protective film may be used in a similar manner as the tape in that a majority of the film is removed after installation, but a portion of the protective film would remain disposed between the stile and the glass panel.

The exemplary door 100 provided in the present disclosure may have a rectangular shape with stiles (not shown) aligned vertically along two vertical edges of the door and rails (not shown) aligned horizontally along two horizontal edges of the door. A quadrilateral frame may be used in some embodiments. Such a door frame may be formed of a top rail, a bottom rail, a right stile and a left stile joined together to form said frame. In some embodiments, the door 100 comprises a top rail, a bottom rail, a right stile and a left stile joined together to form a frame quadrilateral door frame. The skins 110, 120 are joined together through the interlocking structure 150 of the flange portions 116, 126. The two skins may be bonded to the rails and stiles. The method 200 may also comprise steps of assembling stiles and rails, and bonded skins to the stiles and rails.

In some embodiments, no external window frame members are used to secure the glazing unit 130 to the skins 110, 120. The edge of the glazing unit is disposed adjacent to and between the first tip and the second tip without an external frame member for connecting each of the first skin, the second skin, and the glazing unit. No exterior window frame is used to join the skins together or install the glazing unit into the space between the tips of the skins.

Each component may be made of any suitable material. For example, the skins 110, 120 comprise a material of a glass fiber or mineral reinforced polymer composite. The stiles and the rails may comprise laminated veneer lumber (LVL), a composite comprising wood and polyvinyl chloride, or any other suitable materials. In some embodiments, fiberglass door skins are formed of sheet molding compound (or SMC) sheets containing resinous sheets reinforced with fiberglass, often chopped fiberglass or fiberglass mats.

In some embodiments, those inter-lock profiles are made from fiberglass, PVC, metal, wood or any combination thereof. The flange portions 116, 126 of the skins 110, 120 for the interlocking structure 150 may be directly molded as a unitary part of the skins. In some embodiments, the flange portions for the interlocking structure may be bonded and attached to the skins. In some embodiments, those inter-lock profiles are assembled with 45 degrees on the corner cut and glued to the skins 110, 120. In addition to the 45-degree cut, different interlocking structures may be formed at the corners.

In some embodiments, the flange portions 116, 126 for the male/female interlocking structure 150 are continuous through all the edges in the opening for the glazing unit 130. In some other embodiments, the flange portions 116, 126 for the interlocking structure 150 are discontinuous through all the edges in the opening for the glazing unit. In some embodiments, the interlocking structure 150 has the same male/female configuration. In some other embodiments, the first flange portion 116 and the second flange portion 126 are interconnected through alternating male/female interlocking structures as described in FIG. 3C.

On one side of the interlocking structure 150 (opposite to the side for the glazing unit 130), a foam material 140, such as polyurethane foam, fills the space between the two skins 110, 120. Referring to FIGS. 1, 5C and 8E, in some embodiments, foam material 140 exists in a vertical cross-section profile. In a horizontal cross section, foam materials 140 can be replaced with LVL for stiles. The interlocking structure 150 makes the door stronger and also prevents the foam material from leaking through the glass. A glue also may be used on the flange portions to make the interlocking structure even stronger.

The present disclosure also provides a kit for making a door as described herein. Such a kit comprises a first skin 110, a second skin 120, and a glazing unit 130 as described. The kit may also comprise two stiles and two rails. The first skin 110 includes a first skin body portion 112 providing a first outer door surface 114, and a first flange portion 116 connected with and extending inward from the first skin body portion 112. The first skin body portion 112 has a first tip 118. The second skin 120 includes a second skin body portion 122 providing a second outer door surface 124, and a second flange portion 126 connected with and extending inward from the second skin body portion 122. The second skin body portion 122 has a second tip 128. Each flange portion may be unitarily molded with a respective skin or bonded onto the skin as described. The glazing unit 130 includes one or more panes 136, and has an edge shaped and sized to be disposed adjacent to and between the first tip 118 and the second tip 128. The first flange portion 116 and the second flange portion 126 have complementary shapes and sizes, and are configured to be interconnected to provide an interlocking structure 150 in the interior space between the two skins 110, 120.

In some embodiments, the first flange portion 116 comprises a first protrusion 117. The second flange portion 126 defines a first recess 127 for accepting the first protrusion 117. The first flange portion 116 and the second flange portion 126 are configured to be interconnected to provide a male/female interlocking structure 150. In some embodiments, the end of the second flange portion 126 has at least one portion comprising a second protrusion 117. The first flange portion 116 has a corresponding portion defining a second recess 127 for accepting the second protrusion 117. The first flange portion 116 and the second flange portion 126 are configured to be interconnected to provide alternating male/female interlocking structures 150.

In some embodiments, the kit further comprises a tape 160. The tape 160 is shaped and sized to be disposed between the glazing unit 130 and the first tip 118 of the first skin body portion 112 or the second tip 128 of the second skin body portion 122.

The present disclosure provides a skin structure for a door. The skin structure a first skin 110 and/or a second skin 120 as described. Referring to FIGS. 1, 2A-2B, 3A-3B, 5C and 8E, in some embodiments, the skin structure comprises a first skin 110 including a first skin body portion 112 providing a first outer door surface 114 and a first flange portion 116 connected with and extending inwardly from the first skin body portion 112. An end of the first flange portion 116 has a first protrusion 117. The skin structure may further comprise a second skin 120 including a second skin body portion 122 providing a second outer door surface 124 and a second flange portion 126 connected with and extending inwardly from the second skin body portion 112. An end of the second flange portion 126 has a first recess 127. The first protrusion 117 is configured to be disposed within the first recess 127 thereby forming at least a first portion of an interlocking structure 150. Referring to FIG. 3C, in some embodiments, the end of the second flange portion 126 includes a second protrusion 117, and the end of the first flange portion 116 defines a second recess 117. The second protrusion 117 configured to be disposed within the second recess 127 thereby forming at least a second portion of the interlocking structure 150. The present disclosure also provides an assembled skin structure as described.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A door comprising:

a first skin including a first skin body portion and a first flange portion connected with and extending inwardly from the first skin body portion, the first skin body portion having a first tip;

a second skin including a second skin body portion and a second flange portion connected with and extending inwardly from the second skin body portion, the second skin body portion having a second tip; and a glazing unit including one or more panes, the glazing unit having an edge disposed adjacent to, and between, the first tip and the second tip, wherein an end of the first flange portion and an end of the second flange portion have complementary shapes and are interconnected so as to provide an interlocking structure, the interlocking structure being a male-female interlocking structure, wherein the first skin, including the first skin body portion and the first flange portion, is a unitary structure, and the second skin, including the second skin body portion and the second flange portion, is a unitary structure, the first skin body portion being separate from the second skin body portion, wherein the edge of the glazing unit is disposed inside a void defined by the first tip, the second tip, the first flange portion, and the second flange portion, without a frame member for connecting the first skin, the second skin, and the glazing unit, wherein the first skin provides a first outer surface of the door, the second skin provides a second outer surface of the door, the first outer surface and the second outer surface extend along and cover two exterior sides of the door beyond the glazing unit; and wherein the first skin body portion and the second skin body portion define a cavity between the first skin and the second skin.

2. The door of claim 1, wherein the end of the first flange portion comprises a first protrusion, the end of the second flange portion defines a first recess, and the first protrusion is disposed within the first recess thereby forming at least a portion of the interlocking structure.

3. The door of claim 2, wherein the end of the second flange portion includes a second protrusion, the end of the first flange portion defines a second recess, and the second protrusion is disposed within the second recess thereby forming at least a second portion of the interlocking structure.

4. The door of claim 1, further comprising an adhesive disposed between the end of the first flange portion and the end of the second flange portion in the interlocking structure.

5. The door of claim 1, wherein the first flange portion and the second flange portion of the interlocking structure comprises a material selected from the group consisting of a fiber glass polymer composite, a polymer, a metal, wood, and any combination thereof.

6. The door of claim 1, wherein the first flange portion of the first skin is substantially normal to a planar surface of the first skin body portion, and the second flange portion of the second skin is substantially normal to a planar surface of the second skin body portion.

7. The door of claim 1, further comprising:

tape disposed between the glazing unit and one of the first tip of the first skin body portion and the second tip of the second skin body portion.

8. The door of claim 1, wherein each of the first skin and the second skin has an inner surface defining a groove for accepting an adhesive or sealant.

9. The door of claim 1, wherein each of the first skin and the second skin comprises a glass fiber filled polymer composite.

10. The door of claim 1, wherein the first skin and the second skin define an opening, and the glazing unit is disposed at the opening.

11. The door of claim 1, further comprising two stiles and two rails, the two stiles are aligned vertically along two vertical edges of the door, and the two rails are aligned horizontally along two horizontal edges of the door.

12. The door of claim 1, further comprising a foamed material disposed inside the cavity between the first skin and the second skin, wherein the foamed material and the edge of the glazing unit are separated by the interlocking structure, and each of the first skin and the second skin includes at least one interior stud disposed in the foamed material.

13. The door of claim 1, further comprising a foam material disposed between the first skin and the second skin, wherein the first flange portion and the second flange portion are disposed between the foam material and the glazing unit.

14. The door of claim 13, wherein each of the first skin and the second skin comprises a plurality of ribs on an interior surface protruding into respective cavities defined by the foamed material.

15. A kit for making a door, comprising:

a first skin including a first skin body portion, and a first flange portion connected with, and extending inwardly from, the first skin body portion, the first skin body portion having a first tip;

a second skin including a second skin body portion, and a second flange portion connected with, and extending inwardly from, the second skin body portion, the second skin body portion having a second tip; and a glazing unit including one or more panes, the glazing unit having an edge shaped and sized to be disposed adjacent to, and between, the first tip and the second tip, wherein an end of the first flange portion and an end of the second flange portion have complementary shapes and sizes, and are configured to be interconnected so as to provide an interlocking structure, the interlocking structure being a male-female interlocking structure, wherein the first skin, including the first skin body portion and the first flange portion, is a unitary structure, and the second skin, including the second skin body portion and the second flange portion, is a unitary structure, the first skin body portion being separate from the second skin body portion, wherein the edge of the glazing unit is disposed inside a void defined by the first tip, the second tip, the first flange portion, and the second flange portion, without a frame member for connecting the first skin, the second skin, and the glazing unit, wherein the first skin is configured to provide a first outer surface of the door, the second skin is configured to provide a second outer surface of the door, the first outer surface and the second outer surface extend along and cover two exterior sides of the door beyond the glazing unit; and wherein the first skin body portion and the second skin body portion define a cavity between the first skin and the second skin.

16. The kit of claim 15, wherein the end of the first flange portion comprises a first protrusion, the end of the second flange portion defines a first recess, and the first flange portion and the second flange portion are configured to be interconnected so as to provide the male/female interlocking structure.

17. The kit of claim 16, further comprising: tape shaped and sized to be disposed between the glazing unit and the first tip of the first skin body portion or the second tip of the second skin body portion.

18. The kit of claim 15, wherein the end of the second flange portion has at least one portion comprising a second protrusion, the end of the first flange portion has a corresponding portion defining a second recess for accepting the second protrusion, and the first flange portion and the second flange portion are configured to be interconnected so as to provide additional alternating male/female interlocking structures, in which the first skin and the second skin alternatingly provide protrusions as male structures and recesses as corresponding female structures, respectively.

19. A method for making a door, comprising:

providing a first skin including:

a first skin body portion, and a first flange portion connected with and extending inward from the first skin body portion, the first skin body portion having a first tip;

providing a second skin including:

a second skin body portion, and a second flange portion connected with and extending inward from the second skin body portion, the second skin body portion having a second tip, wherein an end of the first flange portion and an end of the second flange portion have complementary shapes and sizes;

installing a glazing unit, the glazing unit including one or more panes, and having an edge disposed adjacent to and between the first tip and the second tip; and connecting the first skin and the second skin so as to provide an interlocking structure and a cavity between the first skin and the second skin defined by the first skin body portion and the second skin body portion, the first skin body portion being separate from the second skin body portion, the interlocking structure being a male-female interlocking structure, wherein the first skin, including the first skin body portion and the first flange portion, is a unitary structure, and the second skin, including the second skin body portion and the second flange portion, is a unitary structure, wherein the edge of the glazing unit is disposed inside a void defined by the first tip, the second tip, the first flange portion, and the second flange portion, without a frame member for connecting the first skin, the second skin, and the glazing unit, and wherein the first skin provides a first outer surface of the door, the second skin provides a second outer surface of the door, the first outer surface and the second outer surface extend along and cover two exterior side of the door beyond the glazing unit.

20. The method of claim 19, wherein the first or second skin is provided by molding the first or second skin including the respective skin body portion and the respective flange portion in a unitary structure.

21. The method of claim 19, wherein providing the first skin or the second skin comprises steps of molding a molded prototype comprising an extra portion connected with the first tip or the second tip, and removing the extra portion after molding the first skin or the second skin.

22. The method of claim 19, further comprising:

applying a tape between the glazing unit and the first tip of the first skin body portion or the second tip of the second skin body portion.

23. The method of claim 22, further comprising:

painting the first or second skin; and peeling off a portion of the tape, extending outside the first tip or the second tip.

24. A skin structure for a door comprising:

a first skin including a first skin body portion and a first flange portion connected with and extending inwardly from the first skin body portion, the first skin body portion having a first tip, an end of the first flange portion having a first protrusion; and a second skin including a second skin body portion and a second flange portion connected with and extending inwardly from the second skin body portion, the second skin body portion having a second tip, an end of the second flange portion having a first recess, wherein the first protrusion is configured to be disposed within the first recess thereby forming at least a first portion of a male-female interlocking structure, wherein the first skin, including the first skin body portion and the first flange portion, is a unitary structure, and the second skin, including the second skin body portion and the second flange portion, is a unitary structure, wherein the first skin and the second skin are configured to hold a glazing unit, wherein an edge of the glazing unit is disposed inside a void defined by the first tip, the second tip, the first flange portion, and the second flange portion, without an a frame member for connecting the first skin, the second skin, and the glazing unit, wherein the first skin provides a first outer surface of the door, the second skin provides a second outer surface of the door, the first outer surface and the second outer surface extend along and cover two exterior sides of the door beyond the glazing unit; and wherein the first skin body portion and the second skin body portion define a cavity between the first skin and the second skin, the first skin body portion being separate from the second skin body portion.

25. The skin structure of claim 24, the end of the second flange portion includes a second protrusion, the end of the first flange portion defines a second recess, and the second protrusion configured to be disposed within the second recess thereby forming at least a second portion of the interlocking structure.

* * * * *